US007267197B2

(12) United States Patent
Camaioni

(10) Patent No.: US 7,267,197 B2
(45) Date of Patent: Sep. 11, 2007

(54) ADD-ON EXTENSION LADDER

(76) Inventor: Frank Camaioni, 50 Forest Lawn Ave., Stamford, CT (US) 06905

( * ) Notice: Subject to any disclaimer, the term of this patent is extended or adjusted under 35 U.S.C. 154(b) by 492 days.

(21) Appl. No.: 10/660,988

(22) Filed: Sep. 12, 2003

(65) Prior Publication Data

US 2004/0055823 A1 Mar. 25, 2004

Related U.S. Application Data

(60) Provisional application No. 60/413,303, filed on Sep. 25, 2002.

(51) Int. Cl.
*E06C 1/10* (2006.01)

(52) U.S. Cl. ..... 182/178.4; 182/207; 182/107

(58) Field of Classification Search ..... 182/107, 182/214, 178.2, 178.4, 207
See application file for complete search history.

(56) References Cited

U.S. PATENT DOCUMENTS

| | | | | | |
|---|---|---|---|---|---|
| 124,940 | A * | 3/1872 | Edmunds | 182/206 |
| 146,274 | A * | 1/1874 | Parent | 182/106 |
| 466,816 | A * | 1/1892 | Wilson | 182/213 |
| 1,600,572 | A * | 9/1926 | Bauer | 248/238 |
| 1,672,020 | A * | 6/1928 | Brugner | 182/25 |
| 2,471,110 | A * | 5/1949 | Jenkins | 182/129 |
| 2,720,354 | A * | 10/1955 | Stanley | 182/207 |
| 3,266,593 | A * | 8/1966 | Okie et al. | 182/27 |
| 3,428,417 | A | 2/1969 | Gordon | |
| 4,143,742 | A | 3/1979 | Fernandez | |
| 4,249,638 | A | 2/1981 | Fernandez | |
| 4,519,478 | A * | 5/1985 | Hulme et al. | 182/178.4 |
| 4,605,100 | A | 8/1986 | Inglese | |
| 4,607,726 | A | 8/1986 | Davis et al. | |
| 5,027,923 | A | 7/1991 | Derome | |
| 5,099,952 | A | 3/1992 | Farrell | |
| D380,277 | S | 6/1997 | Bonn et al. | |
| 5,715,908 | A | 2/1998 | Sager | |
| 6,412,600 | B1 * | 7/2002 | Wolfman | 182/107 |
| 6,782,972 | B1 * | 8/2004 | Hatch et al. | 182/102 |
| 2004/0069567 | A1 * | 4/2004 | Wollenberg et al. | 182/107 |

FOREIGN PATENT DOCUMENTS

GB 2118236 A * 10/1983

* cited by examiner

*Primary Examiner*—Alvin Chin-Shue
(74) *Attorney, Agent, or Firm*—Mark P. Stone

(57) ABSTRACT

An add-on extension ladder is removably mountable to a portion of a conventional ladder to extend the reach of the conventional ladder without any structural modification to the conventional ladder. The add-on extension has integral elements for engaging rungs on the upper portion of the conventional ladder to easily mount and remove the extension ladder to and from the conventional ladder.

20 Claims, 6 Drawing Sheets

ADD-ON EXTENSION LADDER

This application claims the benefit of provisional Application Ser. No. 60/413,303, filed on Sep. 25, 2002.

BACKGROUND OF THE INVENTION

The present invention is directed to an add-on extension for conventional ladders, as for example ladders used by painters and other home improvement or construction personnel. In particular, the add-on extension ladder in accordance with the present invention is advantageously used in conjunction with conventional two section telescoping ladders.

Typical ladders are exemplified by U.S. Pat. Nos. 5,715,908; 5,099,952; 5,027,923; 4,607,726; 4,605,100; 4,249,638; 4,143,742; 3,428,417; and Des 380,277.

U.S. Pat. No. 4,519,478 illustrates a known add-on extension section for a conventional ladder. However, the extension ladder illustrated by this patent is disadvantageous in many respects. Among other things, the conventional ladder with which the add-on extension section is to be used requires significant structural modification to enable it to be effectively coupled to the add-on extension.

It is the primary object of the present invention to provide an add-on extension section for a conventional ladder, including a two section telescoping ladder, which is simple in construction, inexpensive to produce, and which does not require structural modification to the standard ladder to removably mount the extension section thereto. Other objects and advantages of the present invention will become apparent from the following description in conjunction with the drawings.

SUMMARY OF THE INVENTION

The present invention provides an add-on extension ladder adapted to be removably mounted to a conventional ladder, as for example, a standard two section telescoping ladder. A conventional ladder is generally 12 feet in length, a conventional two section telescoping ladder is generally 24 feet in length, and a conventional three section telescoping ladder is generally 36 feet in length. Painters, servicemen, and other home repair and construction personnel are generally able to accomplish all tasks using either a single section 12 foot ladder or a 24 foot two section telescoping ladder. A single section ladder is less expensive than a two section telescoping ladder which is less expensive than a three section telescoping ladder. For workmen requiring only a single section ladder to perform the vast majority of their daily activities, it is an unneccessary expense to purchase a two section telescoping ladder for use on the infrequent occasions when extra height is needed. Similarly, where a two section telescoping ladder meets most of workmen's normal requirements, it is an unnecessary expense for the workman to purchase a more expensive three section telescoping ladder for use on the infrequent occasions when the additional length is necessary. The add-on extension ladder in accordance with the present invention enables a workman to use the conventional ladder to accomplish most of the necessary on-job activities, and removably mount the extension section to the conventional ladder on the infrequent occasions when additional ladder length is necessary. In this manner, it is unnecessary for a workman to purchase a conventional, but more expensive longer ladder, when the extra length provided by the longer ladder is not necessary to accomplish most of the tasks performed by the workman.

The add-on extension ladder in accordance with the present invention provides a separate extension section for a conventional ladder which is readily mountable to, and removable from, the top portion of the conventional ladder. The conventional ladder does not require any structural modification to enable it to removably receive the add-on ladder section. Preferably, the add-on ladder section has means for engaging at least two separate rungs near the top portion of the conventional ladder to enhance the stability of the extension section when it is mounted to the conventional ladder, and the width of the extension section is preferably greater than the width of the upper section of the conventional ladder so as to more evenly distribute the weight of the add-on extension section over the length of the rung of the conventional ladder engaged by the extension section.

Although the extension section will be firmly engaged on at least two separate rungs of the conventional ladder to enhance the stability of the extension section when it is mounted to the top portion of a conventional ladder, supplemental locking means may also be provided. Such supplemental locking means can include aligned openings in corresponding portions of the sidewalls of the conventional ladder and the extension section, and a locking pin removably receivable within the aligned openings in the sidewalls when the extension section is mounted to the conventional ladder.

The add-on ladder section in accordance with the present invention avoids the necessity of purchasing an expensive longer ladder which may only be used on an intermittent basis, and enables the use of a smaller, less expensive conventional ladder on a regular basis with the option of mounting the add-on ladder section to the conventional ladder on the infrequent occasions when a longer ladder is needed.

DESCRIPTION OF THE BEST MODES FOR CARRYING OUT THE INVENTION

Figure 1:
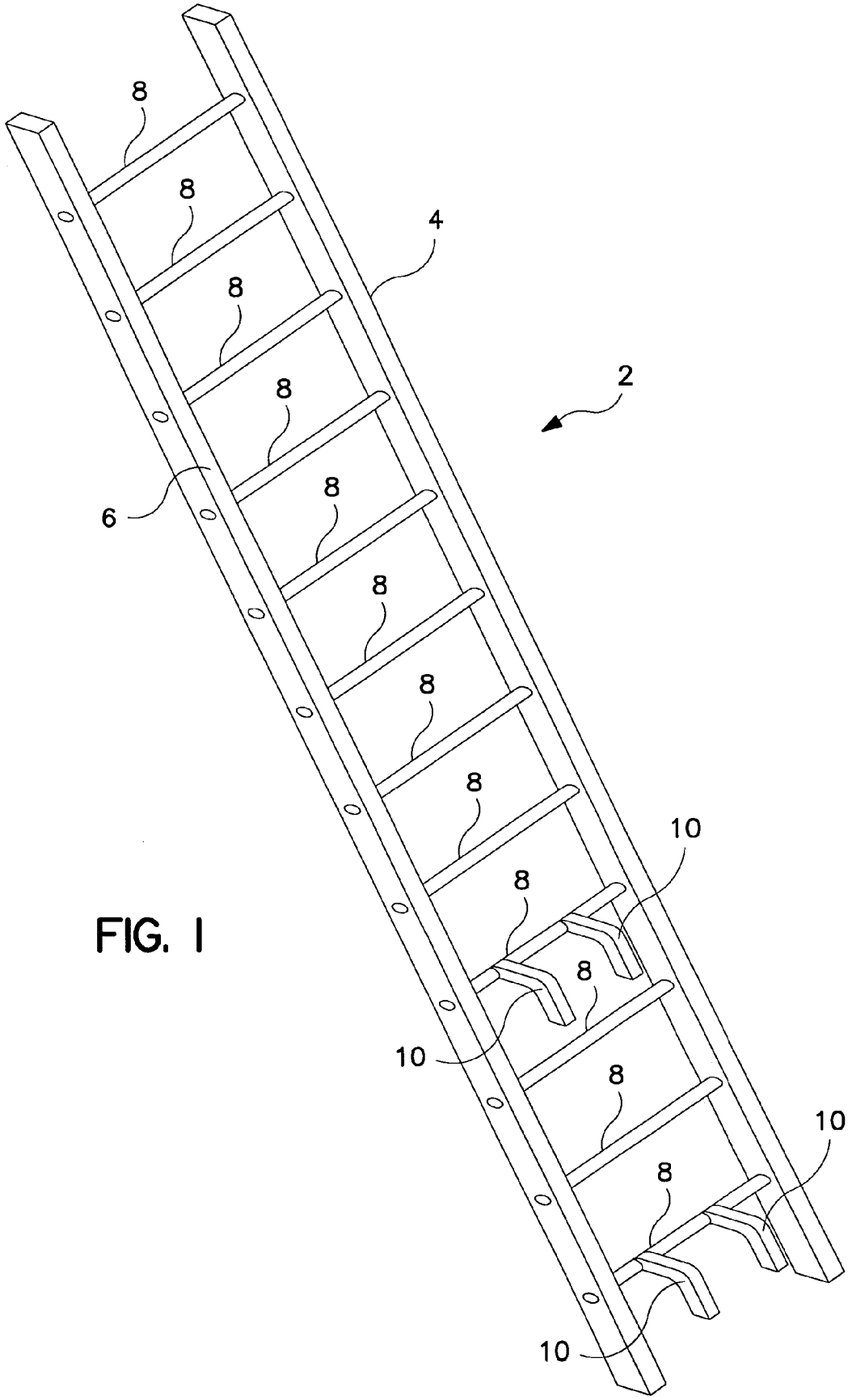
FIG. 1 illustrates a perspective view of a ladder extension section in accordance with the preferred embodiment of the present invention.
Figure 2:
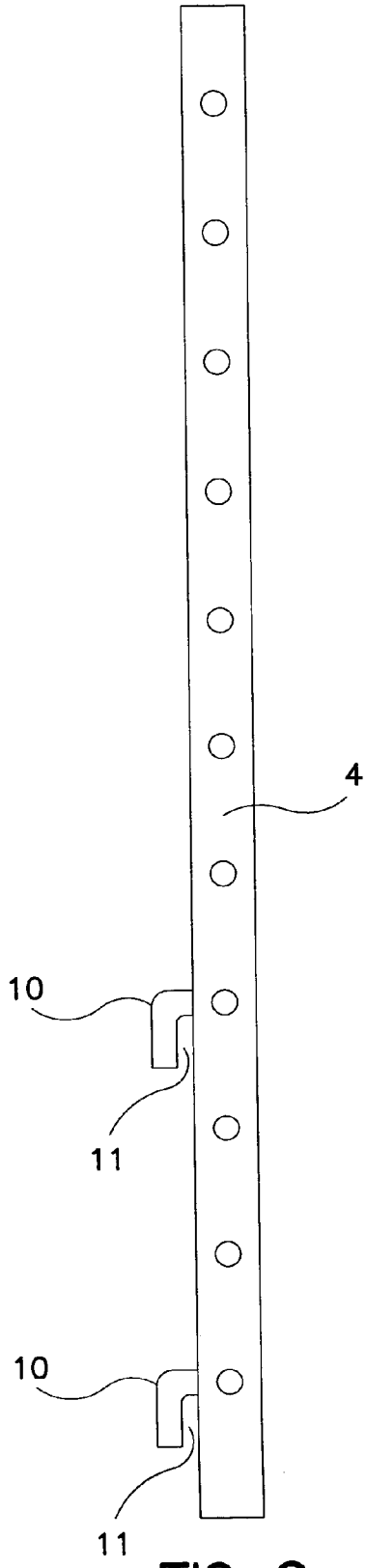
FIG. 2 is a side view of the ladder extension section illustrated by FIG. 1.

The preferred embodiment of the add-on ladder section in accordance with the present invention is illustrated by FIGS. 1-3 of the drawing.

FIGS. 1 and 2 illustrate, respectively, a perspective and side elevational view of the add-on ladder extension section in accordance with the present invention by itself. The extension section, generally designated by reference numeral 2, includes two opposed, longitudinally extending sidewalls, generally designated by reference numerals 4 and 6. A plurality of transversely oriented rungs 8 extend between the opposed sidewalls 4 and 6. A pair of engagement elements, generally designated by reference numeral 10, are each mounted to two separate rungs 8 at the bottom half of the ladder extension section 2.

As best illustrated by FIG. 2 of the drawing, engagement elements 10 extend downwardly from the respective rungs 8 to which the engagement elements are mounted. The engagement elements 10 can be integrally formed with the rungs to which they are mounted, or the engagement elements can be separately mounted to the rungs of the extension section 2 after the extension section has been fabricated. As shown in FIG. 2, the engagement elements 10 are generally L-shaped, and define a relatively large space or channel designated by reference numeral 11, for receiving the rungs of a conventional ladder for removably mounting the extension section to a conventional ladder.

Figure 3A:
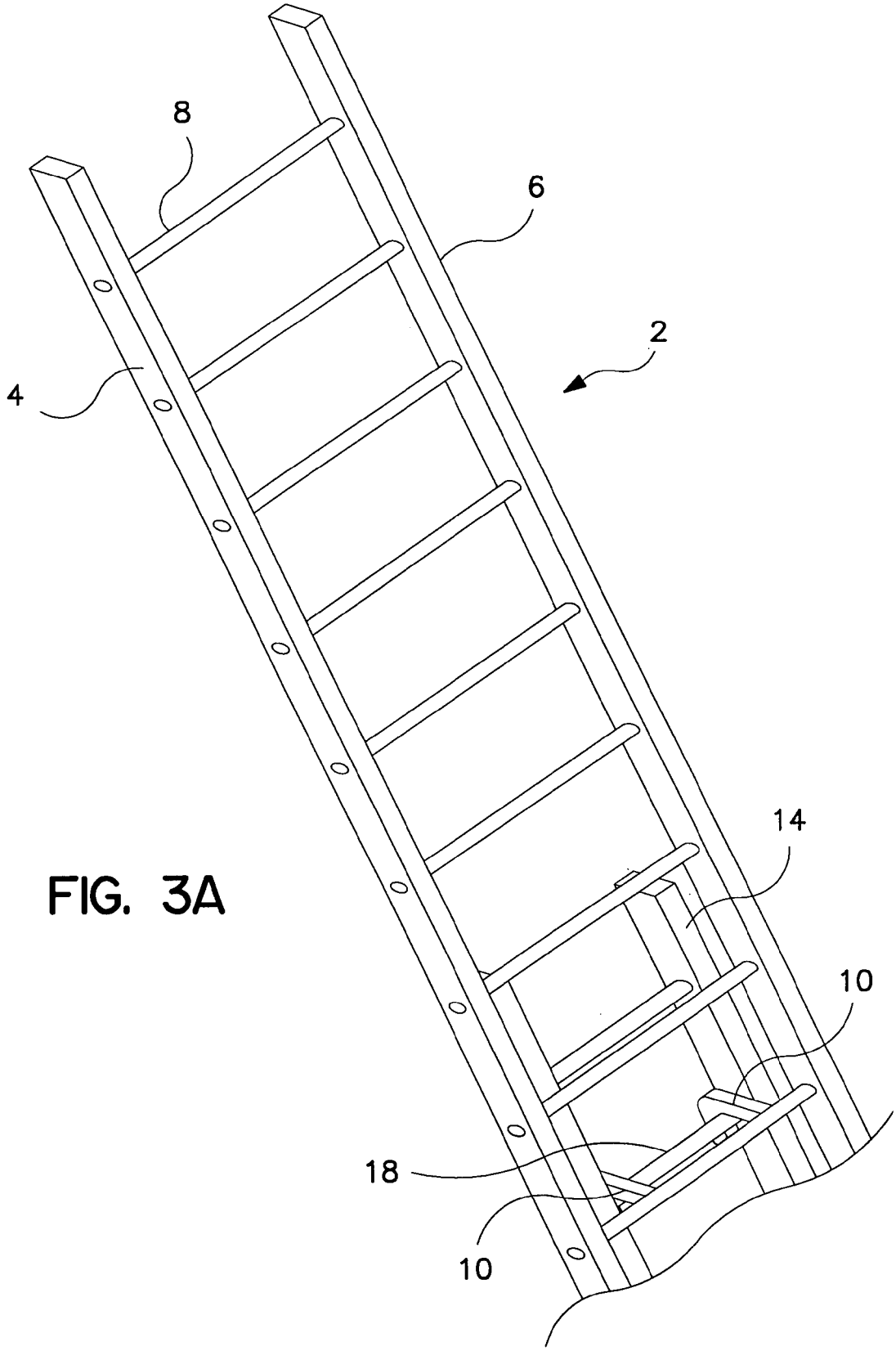
FIGS. 3A-3C illustrate a conventional two section telescoping ladder in an extended position, with the ladder extension section illustrated by FIGS. 1 and 2 removably mounted to the top portion of the upper extended section of the conventional telescoping ladder.
Figure 3B:
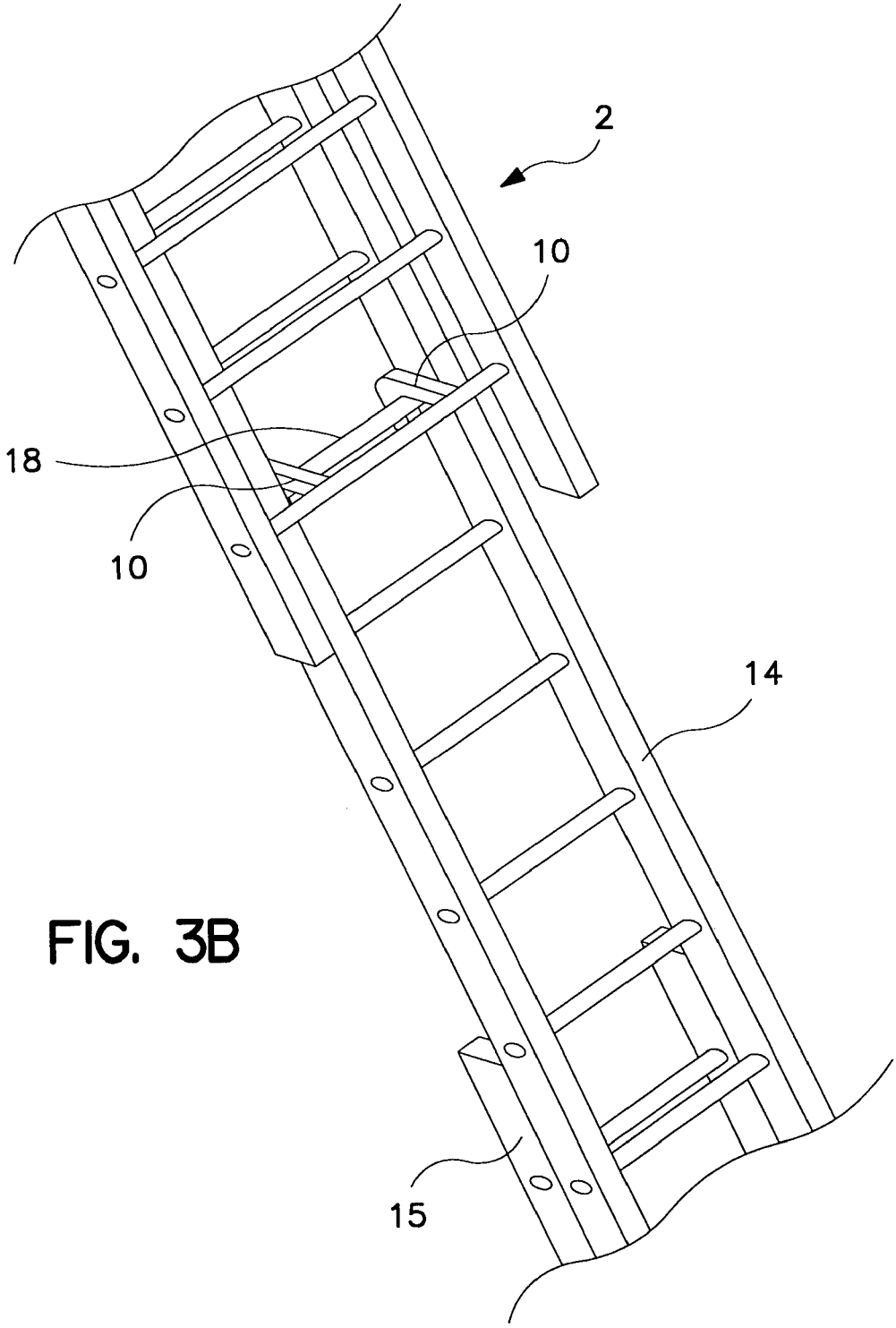
Figure 3C:
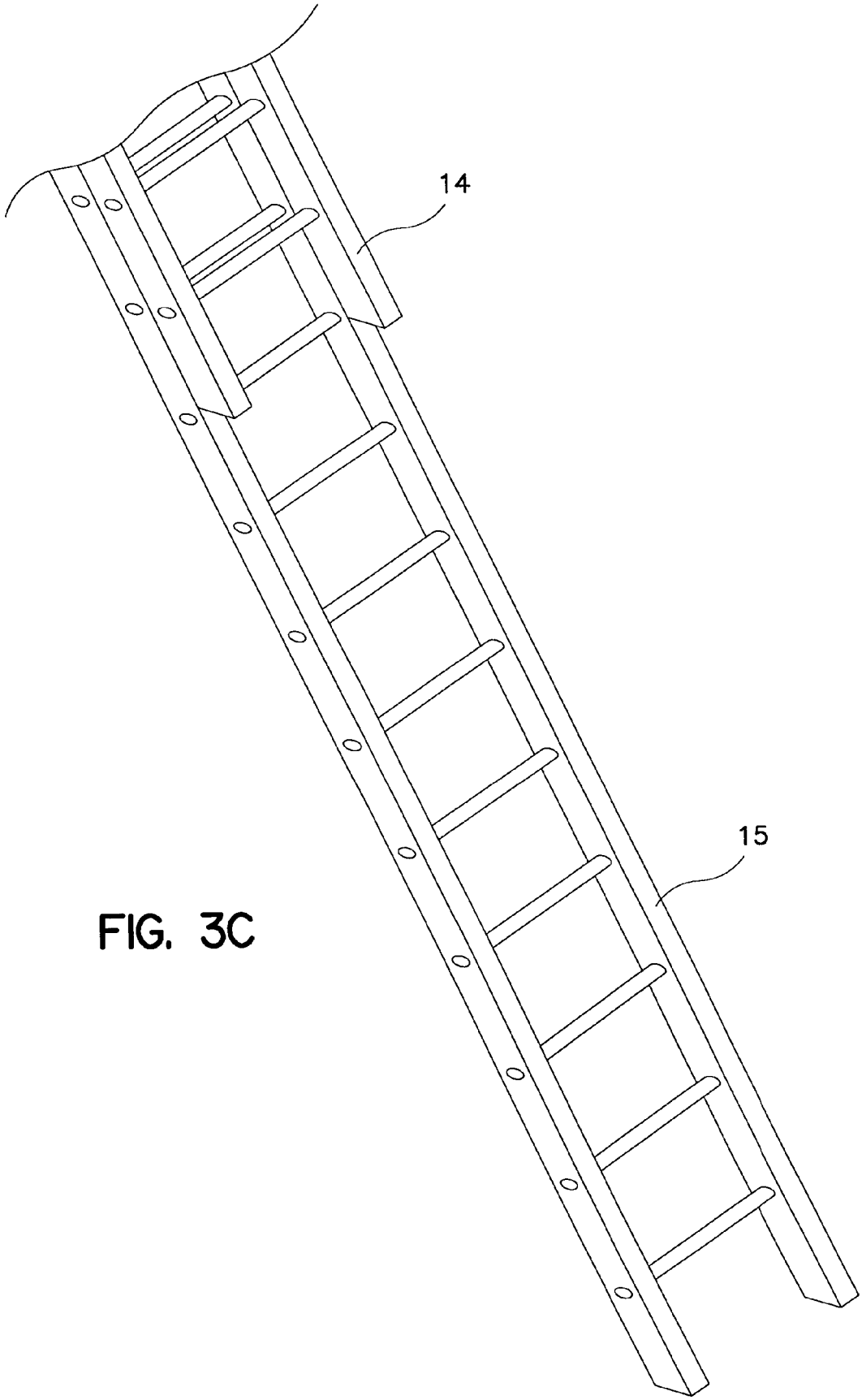

FIGS. 3A-3C illustrate a conventional two section telescoping ladder generally designated by reference numeral 12. FIG. 3A illustrates the ladder extension 2 extending from the top section 14 of the conventional ladder; FIG. 3B illustrates the top section 14 of the conventional ladder extended from the bottom section 15 of the conventional ladder; and FIG. 3C illustrates the bottom section 15 of the conventional ladder with the top section 14 of the conventional ladder extended from the top thereof. The ladder 12 is shown in its operational position in which the upper ladder section 14 extends outwardly and above the lower ladder section 15. The add-on ladder extension section 2 is shown mounted to the upper extended section 14 of the conventional telescoping ladder 12. One rung 18 on the upper extended ladder section 14 engages a pair of engagement elements 10 of the extension section 2, while a second rung of the upper extended ladder section 14 engages the other pair of engagement elements 10 of the extension section 2. Preferably, the extension section 2 is wider than the upper section 14 of the conventional ladder so as to more evenly distribute the weight of the extension section along the length of the rungs of the upper extended ladder section 14 to which the extension section 2 is mounted. Preferably, the upper pair of engagement elements 10 will not be mounted to the upper rung of the extended ladder section 14 to enhance the balance of the extension section 2 on the upper extended ladder section 14, although the extension section 2 is preferably mounted to the top half of the upper extended ladder section 14. When the extension section 2 is mounted to the top portion of the extended ladder section 14, the extension section is maintained on the upper ladder section 14 as a result of gravitational forces which drive the engagement elements 10 into positive engagement and contact with the rungs of the upper extended ladder section 14. Preferably, the width of the extension section 2 will be slightly greater than the width of the upper extended ladder section 14 so that the inner surfaces of the sidewalls 4 and 6 of the extension section 2 are close to, or abut against, the outer surfaces of the opposed sidewalls of the extended ladder section 14. In this manner, lateral movement of the extension section 2 relative to the extended ladder section 14 is either minimized or eliminated. It is apparent that the additional length provided by the extension section 2 to the extended ladder section 14 can be adjusted, within limits, by mounting the extension section 2 at different positions along the extended ladder section 14. It is also apparent from the discussion of FIGS. 1-3 that no structural modification to the conventional ladder 12 is necessary to enable the add-on extension section 2 to be removably mounted to the conventional ladder 12.

The add-on extension ladder 2 in accordance with the present invention is securely mountable to the conventional ladder 12 as a result of engagement of the extension section by two separate pairs of engagement elements engaging two separate rungs of the conventional ladder, respectively. However, supplemental locking means can also be provided, if desired, by drilling aligned openings in the sidewalls of the extension section 2 and the conventional ladder at overlapping portions thereof, and removably inserting locking pins into the aligned openings on the opposed sidewalls when the extension section is removably mounted to the conventional ladder.

Preferably, the add-on extension ladder in accordance with the present invention will be approximately 12 foot in length and formed from aluminum. Approximately four feet of the lower portion of the extension section will overlap with four feet of the upper portion of the conventional ladder when the extension section is mounted thereto to provide a relatively long interface area to enhance the stability and balance of the extension section when mounted to the conventional ladder. However, it is within the scope of the present invention to form the extension ladder section 2 from materials other than aluminum, and to form the extension ladder section in lengths other than 12 feet. Additionally, although the preferred embodiment of the invention illustrates an extension section in which engagement elements are provided to engage at least two rungs of a conventional ladder to provide enhanced two point stability, it is also within the scope of the present invention to provide means for engaging the conventional ladder along more than two rungs of the conventional ladder. Additionally, although the preferred embodiment of the invention illustrates that pairs of engagement elements are provided on the extension ladder section 2 for engaging rungs of a conventional ladder, it is within the scope of the present invention to provide only a single engagement element on the extension ladder section 2 for engaging, respectively, each rung of the conventional ladder, or providing more than a pair of engagement elements on the extension ladder section 2 for engaging, respectively, each rung of the conventional ladder.

Figure 4:
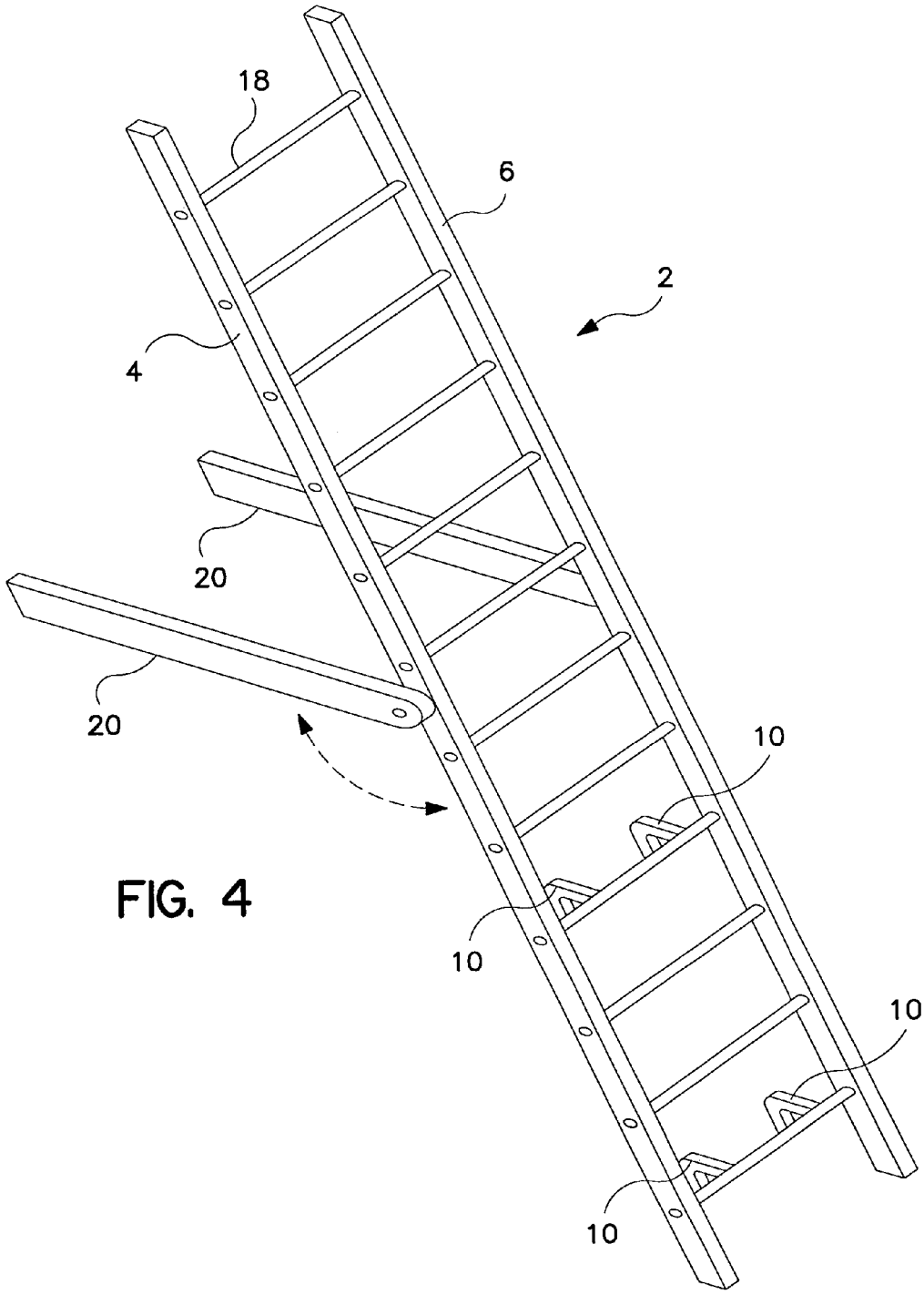
FIG. 4 illustrates the ladder extension section of FIG. 1 with a supplemental support attached to it.

As best illustrated by FIG. 4, a pivotable support element designated by reference numeral 20 can be mounted to the rear of the extension section 2, at or proximate to its midpoint. The support is preferably pivotably mounted to one or both of the sidewalls of the extension section as illustrated by FIG. 4, although it can also be mounted to a rung of the extension section. The support element is outwardly pivotable for engaging a surface against which the ladder is resting (e.g., the side of a house). The support element provides supplemental structural support to the extension section when mounted to the conventional ladder to avoid buckling or bending of the extension section. The support element extends from the same side of the extension section as the engagement elements 10. When not in use, the support is pivoted into a storage postion in which it rests against the rear surface of the extension section.

Other modifications and variations within the scope of the present invention will become apparent to those skilled in the art. Therefore, the discussion of the preferred embodiment of the invention herein is intended to be illustrative only, and not restrictive of the scope of the invention, that scope being defined by the following claims and all equivalents thereto.

The invention claimed is:

1. A combination ladder and ladder extension section adapted to be removably mounted to said ladder, said ladder extension section comprising a pair of opposed sidewalls, a plurality of transversely oriented rungs extending between said pair of opposed sidewalls, and means on said ladder extension section for engaging at least one rung of said ladder for removably mounting said ladder extension section to said ladder, the distance between the pair of opposed sidewalls of said ladder extension section being greater than the distance between the opposed sidewalls of said ladder such that the sidewalls of said ladder extension section extend beyond the sidewalls of said ladder when said ladder extension section is mounted to said ladder.

2. The combined ladder and ladder extension section as claimed in claim 1, wherein said means for engaging is integrally defined on said ladder extension section.

3. The combined ladder and ladder extension section as claimed in claim 1, wherein said means for engaging is affixed to said ladder extension section.

4. The combined ladder and ladder extension section as claimed in claim 1, wherein said means for engaging is formed in a L-shaped configuration.

5. The combined ladder and ladder extension section as claimed in claim 1, wherein said means for engaging defines a channel for removably receiving therein a rung of said ladder.

6. The combined ladder and ladder extension section as claimed in claim 1, wherein said means for engaging comprises a first pair of engagement elements adapted to engage one rung of said ladder, and a second pair of engagement elements adapted to engage another rung of said ladder such that said ladder extension section is removably mountable to said ladder along at least two separate rungs of said ladder.

7. The combined ladder and ladder extension section as claimed in claim 6, wherein each of said engagement elements defines a channel for removably receiving therein a rung of said ladder.

8. The combined ladder and ladder extension section as claimed in claim 1, comprising a support element pivotably mounted to said ladder extension section.

9. The combined ladder and ladder extension section as claimed in claim 8, wherein said support element is mounted to said ladder extension section at the approximate midpoint thereof.

10. The combined ladder and ladder extension section as claimed in claim 9, wherein said means for engaging and said support element each extend from the same side of said ladder extension section.

11. A ladder extension section adapted to be removably mounted to a conventional ladder, said ladder extension section comprising a pair of opposed sidewalls, a plurality of transversely oriented rungs extending between said pair of opposed sidewalls, and means on said ladder extension section for engaging at least one rung of a conventional ladder for removably mounting said ladder extension section to a conventional ladder, the distance between the pair of opposed sidewalls of said ladder extension section being greater than the distance between the opposed sidewalls of a conventional ladder such that the sidewalls of said ladder extension section extend beyond the sidewalls of a conventional ladder when said ladder extension section is mounted to a conventional ladder.

12. The ladder extension section as claimed in claim 11, wherein the distance between said pair of opposed sidewalls of said ladder extension section is selected such that the sidewalls of said ladder extension section abut against the sidewalls of a conventional ladder when said ladder extension section is mounted to a conventional ladder.

13. The ladder extension section as claimed in claim 11, wherein the distance between said pair of opposed sidewalls of said ladder extension section is selected such that a space is defined between the sidewalls of said ladder extension section and the sidewalls of a conventional ladder when said ladder extension section is mounted to a conventional ladder.

14. The ladder extension section as claimed in claim 11, wherein said means for engaging comprises at least one engagement element extending from at least one of said plurality of rungs of said ladder extension section.

15. The ladder extension section as claimed in claim 14, wherein said means for engaging comprises at least one said engagement element extending from at least two of said plurality of rungs of said ladder extension section.

16. The ladder extension section as claimed in claim 14, wherein said at least one engagement element defines a channel for receiving therein a rung of a conventional ladder.

17. The ladder extension section as claimed in claim 11, comprising a support element pivotably mounted to said ladder extension section.

18. A ladder extension section adapted to be removably mounted to a conventional ladder, said ladder extension section comprising a pair of opposed sidewalls, and a plurality of transversely oriented rungs extending between said pair of opposed sidewalls; the width of said ladder extension section being greater than the width of a conventional ladder to which said ladder extension section is mounted so that the sidewalls of said ladder extension section are beyond the sidewalls of a conventional ladder when said ladder extension section is mounted to a conventional ladder; and means on said ladder extension section for engaging at least two rungs of a conventional ladder for removably mounting said ladder extension section to a conventional ladder.

19. The ladder extension section as claimed in claim 18, wherein said means for engaging comprises at least one engagement element extending from at least two of said plurality of rungs of said ladder extension section such that each said engagement element engages a different one of two rungs of a conventional ladder when said ladder extension section is removably mounted to a conventional ladder.

20. The ladder extension section as claimed in claim 19, wherein at least a pair of said engagement elements extends from two of said plurality of rungs of said ladder extension section such that each said pair of engagement elements engages a different one of two rungs of a conventional ladder when said ladder extension section is mounted to a conventional ladder.

* * * * *